United States Patent [19]

Overfelt et al.

[11] Patent Number: 5,032,172

[45] Date of Patent: Jul. 16, 1991

[54] METHOD AND APPARATUS FOR MAKING RAPIDLY SOLIDIFIED PARTICULATE

[76] Inventors: Ruel A. Overfelt, 118 Trout Valley, Hendersonville, Tenn. 37075; William H. Hofmeister, 3204 Overlook Dr., Nashville, Tenn. 37212; Robert J. Bayuzick, 7902 Hwy. 100, Nashville, Tenn. 37221; Michael B. Robinson, 14006 Macbeth Dr., Huntsville, Ala. 35803; David Dillard, 206 Glenstone Cir., Brentwood, Tenn. 37027; Mark Wells, 1505 Sparkman Dr., Apt. 219, Huntsville, Ala. 35816

[21] Appl. No.: 413,638

[22] Filed: Sep. 28, 1989

[51] Int. Cl.[5] ..... C22B 9/00

[52] U.S. Cl. ..... 75/255; 75/245; 75/246; 148/11.5 P

[58] Field of Search ..... 75/93 R, 255, 245, 246, 75/333, 351; 228/148; 148/11.5 P

[56] References Cited

U.S. PATENT DOCUMENTS 4,613,371 9/1986 Cheney ..... 75/93

*Primary Examiner*—Peter D. Rosenberg

*Attorney, Agent, or Firm*—Tilton, Fallon, Lungmus & Chestnut

[57] ABSTRACT

A stream of molten material free falls through a drop tube and impinges on a chill surface adjacent the bottom of the drop tube to form rapidly solidified particulate. The chill surface is so inclined and moved relative to the stream of molten material as to have an upward component of motion counter to the downward direction of fall of the stream to significantly enhance shearing and rapid quenching of molten material striking the chill surface. The resulting solidified particulate is discharged from the chill surface for collection in a particulate collection chamber beneath the chill surface. Production quantities of rapidly solidified particulate can be continuously made.

28 Claims, 5 Drawing Sheets

METHOD AND APPARATUS FOR MAKING RAPIDLY SOLIDIFIED PARTICULATE

FIELD OF THE INVENTION

The present invention relates to a method and apparatus for making particulate by rapidly solidifying molten material on a chill surface.

BACKGROUND OF THE INVENTION

Numerous rapid solidification processes have been investigated for producing alloys with metastable phases and fine microstructures, such as, for example, fine dendritic structures. These processes are characterized by extremely rapid quenching and solidification of molten metal droplets or continuous streams as a result of contact of the molten alloy with a chill member or chill medium (e.g., a cooling gas). Such rapid solidification processes include splat quenching of molten droplets against one or more chill members, melt spinning of a continuous superheated molten stream onto chill rolls or wheels, powder making by melt atomization against a rotating disk and droplet solidification using a cooling gas curtain disposed around the disk, and plasma spray deposition of molten droplets onto a heat conductive substrate.

Drop tube processes have also been investigated for producing metastable phases and fine microstructures in metal alloy systems. In the drop tube process, a molten droplet is formed near the top of an evacuated elongate tube and released so as to fall by gravity through the drop tube. The molten droplet can be significantly undercooled (below its liquidus or freezing temperature) as it falls through the drop tube, solidifies and then is quenched in the quenching medium. The drop tube may be evacuated or may be backfilled with a cooling gas, such as helium, to provide convection cooling of the droplet in addition to radiation cooling.

As described in technical article "Metastable Structures In Drop Tube Processed Niobium Based Alloys", *Adv. Space Res.*, Vol. 6, No. 5, pp. 123–126, 1986 investigators have combined deep undercooling of a molten droplet of Nb-Ge alloy during gravity fall through a drop tube with subsequent rapid solidification of the undercooled droplet in an attempt to minimize recalescence effects and provide metastable structures in the resulting solidified particulate. Rapid solidification of the undercooled droplet was effected by splat quenching the droplet on a stationary copper chill block at the bottom of the drop tube.

The drop tube processes described hereinabove are limited to production of small laboratory quantities (e.g., less than about 0.2 grams) of rapidly solidified particulate since the solidified particulate collects on the stationary copper chill block and must be removed therefrom after only one or a very small number of droplets are quenched thereon. Even such limited quantities of particulate are producible only on an intermittent, discontinuous basis as a result of the need to remove the particulate from the chill block. Moreover, the quench rate achievable in that process is limited by the stationary copper chill block. This limitation reduces the possibility of forming improved and/or unique metastable phases and structures in the undercooled/rapidly solidified particulate.

SUMMARY OF THE INVENTION

The present invention contemplates an improved method and apparatus for making rapidly solidified particulate characterized by the capability to produce the particulate in industrially useful quantities on a more continuous basis.

The present invention also contemplates an improved method and apparatus for making rapidly solidified particulate characterized by the capability to provide enhanced quench rates during rapid solidification of the molten material.

The present invention is practiced by forming a free falling stream of molten material and rapidly solidifying the stream of molten material as particulate by impinging the molten material on a chill (i.e., quench surface) surface so inclined and moving relative to the stream as to have an upward component of motion counter to the downward direction of fall of the stream. The upward component of motion of the chill surface enhances shearing and quenching of the molten material striking the chill surface. The rapidly solidified particulate is discharged from the chill surface, preferably to a particulate collection chamber proximate the chill surface.

Typically, the stream of molten material is formed adjacent the top of an upstanding enclosure, such as a drop tube, and falls by gravity to impact the chill surface disposed adjacent the bottom of the enclosure. The stream of molten material may be formed initially as a stream of molten droplets. The molten droplets may be undercooled (i.e., cooled below the freezing temperature of the molten material) as they fall through the enclosure and prior to impacting the chill surface. Alternately, the stream of molten material may be formed initially as a continuous stream of molten material which may break apart into molten droplets during the free fall (as a result of the well known Rayleigh instability) for impingement against the chill surface with or without any substantial droplet undercooling prior to striking the chill surface.

In one embodiment of the invention, the chill surface comprises a flat, circular, upwardly facing surface of a rotating chill disk made of heat conductive material. In another embodiment of the invention, the chill surface comprises a flat, upwardly facing surface of an endless chill belt of heat conductive material. The latter chill surface provides a uniform chill surface velocity where the molten material impinges thereagainst.

In another embodiment of the invention, the chill surface is inclined at an acute angle of greater than 0 degrees to less than 90 degrees to the vertical axis of the drop tube.

In still another embodiment of the invention, discharge of the rapidly solidified particulate from the chill surface and toward the collection chamber is facilitated by one or more gas jet devices cooperatively positioned relative to the chill surface for this purpose.

In still another embodiment of the invention where the molten material is undercooled during free fall and then rapidly solidified by impingement on the chill surface, the particulate discharged from the chill surface is separated by shape to permit only properly undercooled/rapidly solidified particulate (i.e., flake-shaped particulate) to enter the collection chamber. Any particulate which was not properly undercooled/rapidly solidified (i.e., spherical shaped particulate) is substantially prevented from entering the collection chamber. A vibrating, apertured grid may be disposed between the chill surface and the particulate collection chamber for this purpose.

Impingement of the stream of molten material on the chill surface inclined and moving relative to the stream as described hereinabove enables more continuous production of industrially viable quantities of rapidly solidified particulate with an enhanced quench rate achievable during rapid solidification.

BRIEF DESCRIPTION OF THE DRAWINGS

In illustrating the present invention, reference may be had to the accompanying drawings in which.

DETAILED DESCRIPTION OF THE INVENTION

Figure 1:
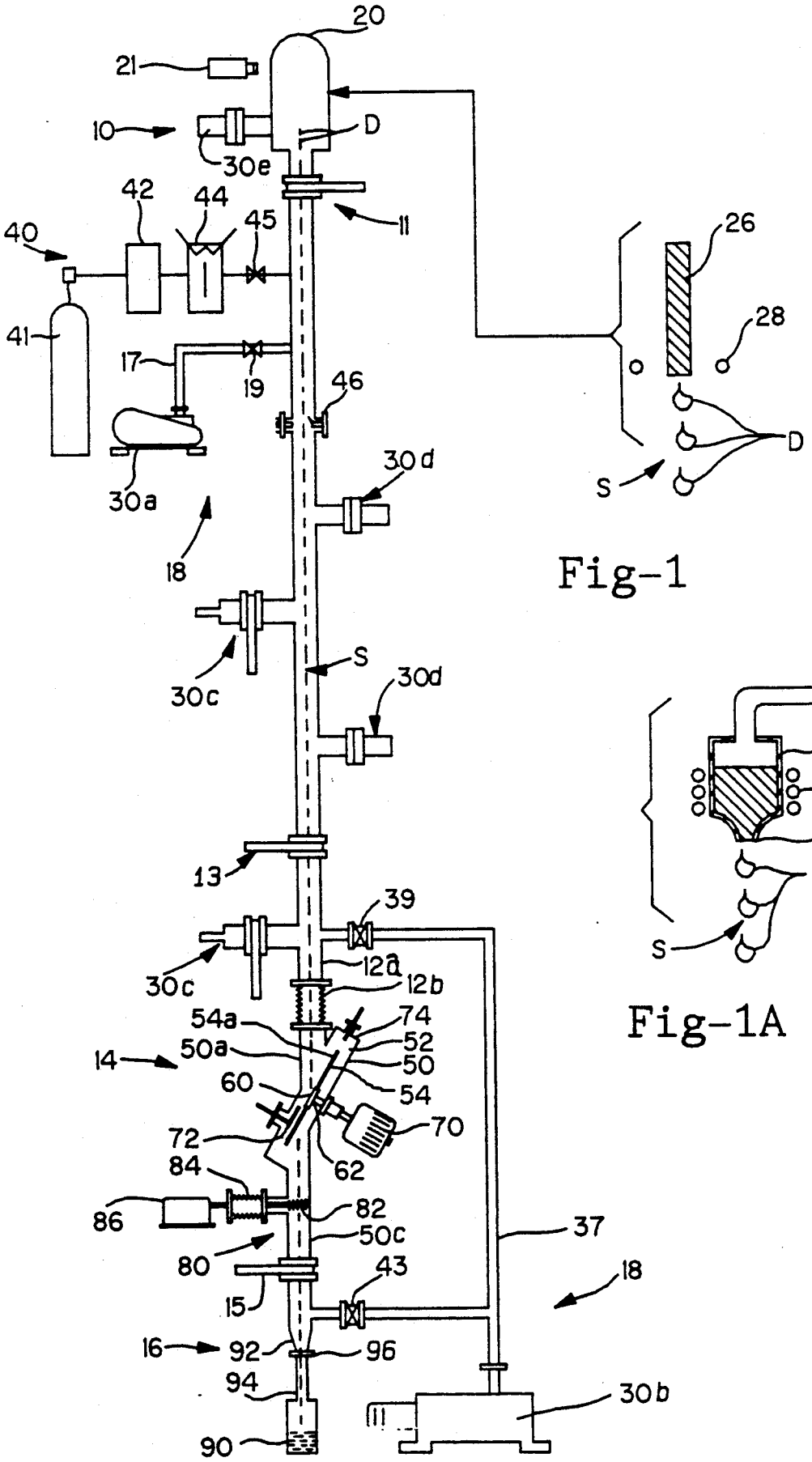
FIG. 1 is a diagrammatic elevational view of the apparatus of the invention.

The invention can be practiced to make rapidly solidified particulate from a wide variety of materials such as metals/alloys, glasses, metallic glasses, ceramics, etc. Metals and alloys usable in practicing the invention include but are not limited to the high melting point refractory metals (e.g., Nb, W, Mo, etc.) and their alloys, reactive metals and alloys (e.g., Ti, Al, rare earth bearing alloys, etc.) and intermetallics (e.g., titanium aluminides, nickel aluminides, etc.). The refractory metals/alloys are particularly well suited for manufacture as undercooled/rapidly solidified particulate as a result of their relatively high melting temperature and the significant undercooling achievable as a result.

However, although the invention has the capability of producing undercooled/rapidly solidified particulate, it is not so limited and may be used to make rapidly solidified particulate from superheated molten material without undercooling of the molten material prior to impingement on the chill surface. For example, lower melting temperature, reactive metals/alloys are producible as rapidly solidified particulate in accordance with the invention with or without some degree of undercooling depending upon the initial temperature of the molten metal. These metals and alloys can be produced as rapidly solidified particulate while protected against oxidation by the ultra high vacuum or high purity inert gas environmental capability of the invention.

FIGS. 1–4 illustrate an apparatus that may be used in practicing one embodiment of the invention for making undercooled/rapidly solidified metallic particulate. Generally, the apparatus comprises a molten metal stream forming system 10, a cylindrical drop tube 12 (i.e., an upstanding enclosure), a quenching system 14, a particulate collection system 16 and an environmental control system 18 for providing a vacuum or inert gas environment in the aforementioned systems 10, 12, 14 and 16. The molten metal stream forming system 10 and the drop tube 12 can be sealed off from one another by an upper isolation gate valve 11. The drop tube 12 can be sealed off from the quenching system 14 and collection system 16 by a lower isolation gate valve 13. Moreover, a second lower isolation gate valve 15 can be closed to seal off the quenching system 14 and the collection system 16 from one another.

The molten metal stream forming system 10 includes a cylindrical bell jar 20 sealingly engaged on the top of the drop tube 12 and a melting device 22 disposed in the bell jar 20 for melting a metallic charge and releasing the melted metallic charge into the drop tube 12 as a free falling stream S (shown schematically) of molten metal. The melting device 22 may be selected from conventional melting apparatus depending on the type of metal/alloy charge to be melted, the type of melting environment employed (e.g., vacuum or inert gas) and other factors. In particular, as shown in FIG. 1, the melting device 22 may comprise a rod or wire 26 of the metal/alloy to be melted that is fed by suitable feed means (not shown) into an electron beam furnace 28 to melt droplets D (shown schematically) from the end of the wire. The droplet size is determined by the solid wire to liquid drop surface tension, the diameter of the wire and the density of the alloy. This wire or rod melting technique is especially useful when a relative vacuum environment is provided in the bell jar and the drop tube.

Figure 1A:
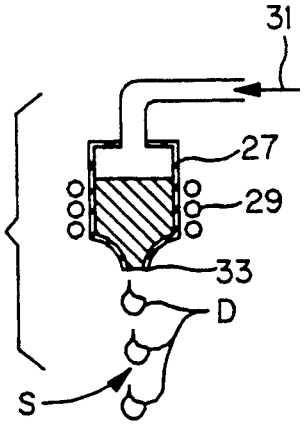
FIG. 1A is a partial diagrammatic elevational view of an alternative molten metal stream forming device to form a discontinuous stream of molten droplets to fall through the drop tube.

Alternatively, where melting is to be conducted in an inert gas environment, crucible melting can be employed, as shown in FIG. 1A, wherein the metallic charge is melted in a suitable crucible 27 using induction or resistance heating elements 29. Gas pressure from gas supply 31 is used to force the molten charge out of the crucible 27 through a nozzle 33 so configured as to form a stream of molten metal droplets of desired size.

Electromagnetic levitation techniques constitute still another method for melting the metallic charge to form the stream of molten metal droplets. However, to date, the electromagnetic levitation technique is limited in the size of the metallic charge that can be melted and thus, as a result, is not preferred in practicing the invention.

The above-described melting techniques can be used to form superheated molten droplets or undercooled molten droplets for release into the drop tube 12 as may be required for a particular metal/alloy system.

A pyrometer 21 associated with the bell jar 20 is used to determine the temperature of the molten charge formed in the bell jar 20. The bell jar 20 may optionally include a load lock (not shown) to facilitate loading of the metallic charge therein for melting, and a conventional manipulator (not shown) to enable remote handling of the metallic charge in the bell jar 20 after it is sealed on the drop tube 12.

The stream S of molten metal droplets D formed by the molten metal stream forming system 10 is released to free fall through the drop tube 12 toward the quenching system 14. During their fall through the drop tube 12, the droplets D are undercooled (i.e., the temperature of the molten droplets falls below the equilibrium liquidus temperature of the metal alloy without substantial solidification) by radiation heat loss if a relative vacuum is present in the drop tube 12 or by a combination of radiation and convection heat loss if a cooling gas, such as helium, is used in the drop tube 12.

The extent of droplet undercooling achievable for a particular metal/alloy depends upon the size of the droplets D, the length of the free fall through the drop tube 12, the environment (vacuum or inert gas) in the drop tube 12 as well as the initial temperature of the droplets D as they are released from the stream forming system 10. As mentioned hereinabove, when the stream S of droplets D is produced in vacuum in the bell jar 20 using an electron beam melted wire 26, the size of the droplets is determined by solid-liquid surface tension effects, the diameter of the wire and the density of the alloy being melted.

The length of the drop tube 12 is typically fixed for any given facility. However, for a given facility, the drop tube length is selected in the context of achieving desired droplet undercooling and also desired impact velocities within the space constraints, if any, existing at the facility.

The environment within the stream forming system 10, drop tube 12, quenching system 14 and collection system 16 is established by the environmental control system 18. The environmental control system 18 includes commercially available upper and lower dry, "oil-free" roughing vacuum pumps 30*a*, 30*b*, cryopumps 30*c* and sublimation pumps 30*d* that are designed to provide a vacuum level in the melting system 10, drop tube 12, quenching system 14 and collection system 16 of $10^{-9}$ torr or below, although such ultra low vacuum levels are not essential to practicing the method of the invention. For example, vacuum levels of about $10^{-3}$ torr to below about $10^{-10}$ torr can be used.

The upper roughing pump 30*a* is connected to the drop tube 12 via a conduit 17 and roughing valve 19. The lower roughing pump 30*a* is connected to the quenching system 14 and the collection system 16 via a conduit 37 and a respective quench system roughing valve 39 and collection system roughing valve 43.

The number of cryopumps 30*c* disposed along the length of the drop tube 12 is selected so as to minimize pressure gradients therealong. For example, for a 30meter long drop tube 12, six cryopumps 30*c* are positioned generally equally spaced apart along the length of the drop tube 12. The cryopumps 30*c* are operable to evacuate the apparatus from a rough vacuum condition of, for example, $10^{-3}$ torr to a high vacuum condition of, for example, $10^{-8}$ torr without the sublimation pumps 30*d*. The titanium sublimation pumps 30*d* are provided to reduce residual oxygen when a high vacuum environment is employed in the drop tube 12. The sublimation pumps 30*d* are located along the length of the drop tube 12 generally midway of the cryopumps 30*c*. The bell jar 20 includes at least one titanium sublimation pump 30*e* to this same end. The bell jar sublimation pump 30*e* includes an isolation valve since the bell jar 20 is intermittently opened to ambient atmosphere for charging and repairs. No comparable isolation valves are required for the sublimation pumps 30*d* of the drop tube 12 since the drop tube 12 is rarely exposed to ambient atmosphere (isolation gate valves 11 and 13 being closed whenever the bell jar 20 and/or the collection system 16 are opened to ambient atmosphere).

As mentioned hereinabove, the degree of undercooling during free fall of the droplet stream can be increased by backfilling the drop tube 12 with an inert cooling gas, such as helium, argon or mixtures of up to 10 v/o hydrogen with either helium or argon. The inert gas is supplied by a gas supply 40 comprising multiple cylinders 41 (only one shown) of ultra high purity gas. The gas is typically gettered in a gettering device 42 and in addition cold trapped in a liquid nitrogen cryotrap 44 to improve gas purity and eliminate residual moisture therefrom prior to entering the drop tube 12. The gas supply 40 also includes an isolation valve 45 to isolate the aforementioned gas supply components from the drop tube 12 when necessary. The inert cooling gas supplied from cylinders 41 also backfills the molten metal stream forming system 10, quenching system 14 and collection system 16.

Radiometers 46 (only one shown) may be positioned along the length of the drop tube 12, if desired, to monitor the falling droplets D and detect droplet solidification prior to impact on the quenching system 14. Moreover, the apparatus of FIGS. 1-2 typically is provided with one or more mass spectrometers (not shown) to measure and identify gas species at various locations in the apparatus at vacuum levels greater than $10^{-4}$ torr. One or more residual gas analyzers (not shown) may also be used for this same purpose at vacuum levels below $10^{-4}$ torr.

Figure 2:
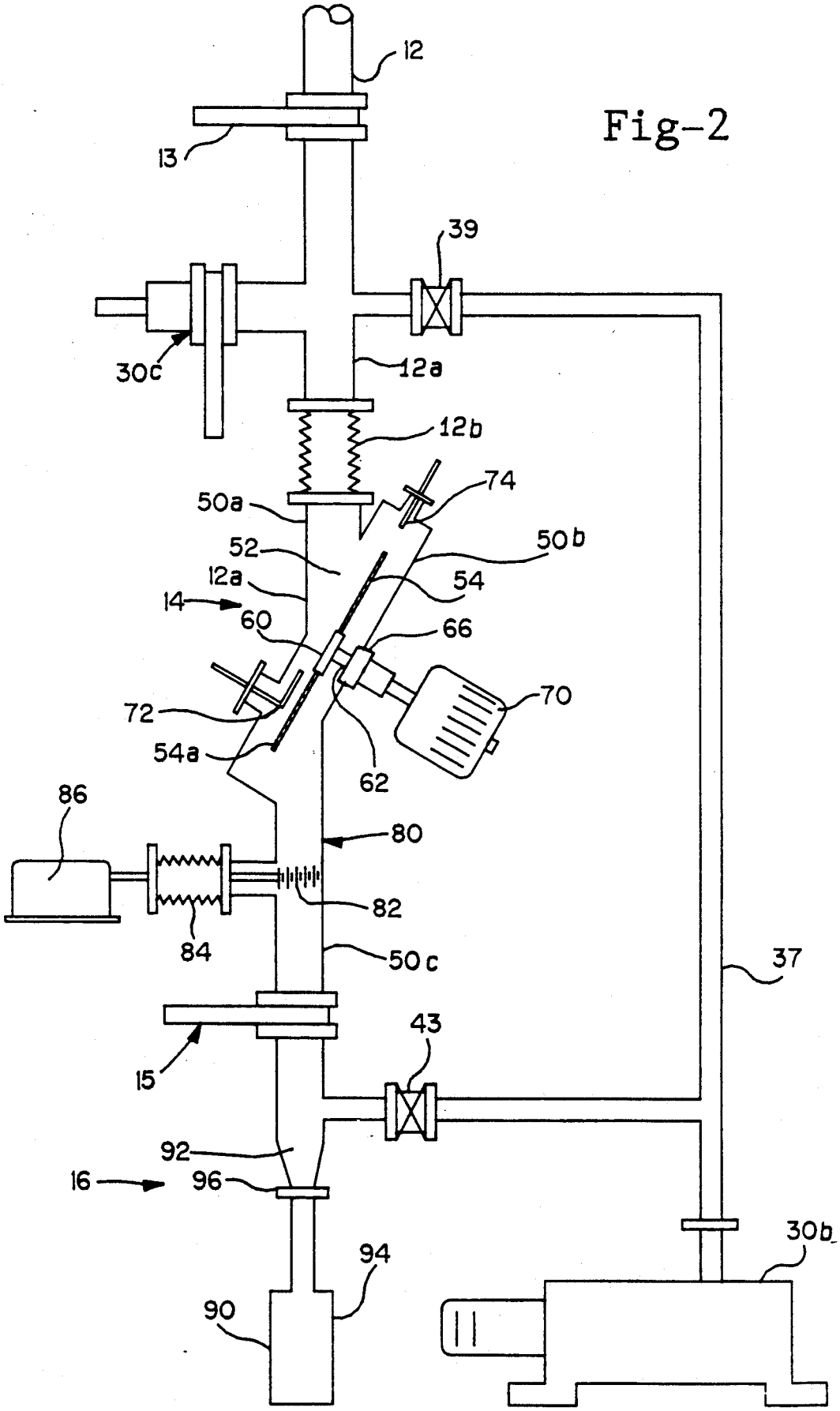
FIG. 2 is an enlarged diagrammatic elevational view of the quench system and particulate collection system of the apparatus of FIG. 1.

The quenching system 14 and the particulate collection system 16 are located adjacent the bottom of the drop tube 12 and are shown in greater detail in FIG. 2. In particular, the quenching system 14 comprises a housing 50 having an upper tube-shaped extension 50*a* connected (e.g., welded) to the bottom 12*a* of the drop tube 12 via a welded-in stainless steel bellows 12*b* for vibration isolation and thermal expansion compensation purposes. Upper tube-shaped extension 50*a*, in effect, constitutes an extension of the drop tube 12.

Figure 3:
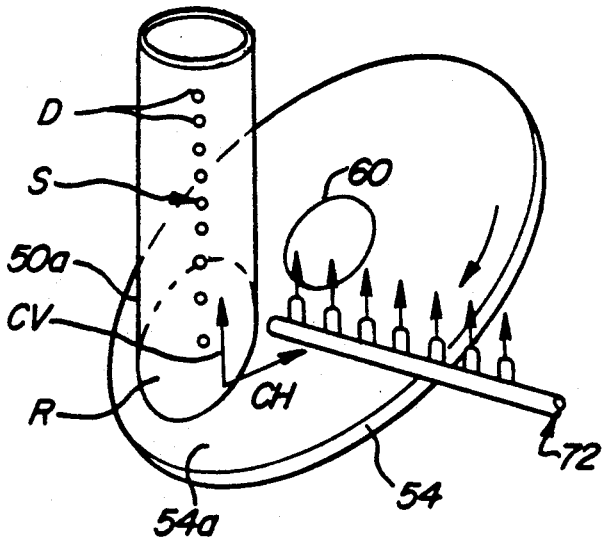
FIG. 3 is a diagrammatic perspective view of the rotating chill (quench) disk and an extension of the drop tube showing the positioned relationship therebetween.

The housing 50 defines a quenching chamber 52 therein. Disposed in the quenching chamber 52 is a rotatable chill (quench) disk 54, preferably comprising oxygen-free copper or stainless steel, although other heat conductive materials may be used. The disk 54 includes an upwardly facing circular, planar chill (quench) surface 54*a* against which the stream S of the undercooled (or superheated) droplets D impinge as they free fall from the drop tube 12. The region R of droplet impingement on the rotating circular chill surface 54*a* is shown in FIG. 3. It is apparent that an elliptical impingement region R is formed on the chill surface 54*a* as a result of its inclination relative to the direction of free fall of the stream S (i.e., the vertical direction). The impingement region R is offset from the rotational axis of the disk 54.

The chill disk 54 is fastened to a hub 60 itself carried on the end of a drive shaft 62 extending through the wall 50*b* of the housing 50. The shaft 62 extends through a high vacuum rotary feedthrough sealing device 66 which includes a ferrofluidic seal (not shown) about the shaft 62.

The rotary feedthrough can accommodate shaft speeds of 4840 RPM maximum. The shaft 62, and thus the chill disk 52, are rotated by a variable speed electrical motor 70 (speed range of 100 RPM to 3600 RPM).

Importantly, the chill (quench) surface 54*a* is inclined at an acute angle relative to the downward vertical direction of free fall of the stream S and is rotated so as to have an upward (vertical) component CV and lateral (horizontal) component CH of motion at the chill impingement region R. As is apparent, the upward component CV of motion is counter to the downward vertical direction of free fall of stream S, e.g., see arrows CV and CH in FIG. 3. Generally, the inclination of the chill surface 54a relative to the stream S, as well as the speed and direction of rotation of the chill surface 54, are selected to maximize the relative velocity differential between the falling droplets D and the upward component CV of motion of the chill surface 54a to optimize shearing and quenching of the droplets D as they impact region R. That is, the differential between the impact velocity of the falling droplets D and the upward component CV of motion of the chill surface 54a is maximized while maintaining a desired horizontal component CH of motion of the chill surface 54a. In FIGS. 1-3, the chill disk 54 is rotated clockwise to provide the desired upward component CV of motion at the offset impingement region R shown where the undercooled droplets impinge. Elongate flake-shaped or platelet-shaped solidified metallic particulate is formed by impingement on the chill surface 54a.

The angle of inclination selected for the chill surface 54a will depend upon the stiffness of the disk 54, the size of the droplets D impinging thereon, the impact velocity of the droplets D and the rotational speed of the chill surface 54a. Angles of inclination greater than 0 degrees and less than 90 degrees can be used depending upon these factors. In an exemplary embodiment of the invention for making rapidly solidified niobium-silicon alloy particulate in a 30 meter long drop tube 12 using alloy droplets of 4 mm diameter, a copper chill disk 54 similar to that shown in FIGS. 1-3 is used and includes a diameter of 24 inches and a thickness of 0.375 inches. The chill surface 54a is inclined relative to the droplet stream at an acute angle of 35 degrees and is rotated at 3600 RPM in a clockwise direction. The chill surface 54a has a surface roughness between about 1 to about 250 microinches, preferably about 100 microinches.

After the droplets D are rapidly quenched and solidified by striking the region R, they are discharged from the chill surface 54a for collection in the particulate collection system 16 as will be explained.

Discharge of the solidified particulate from the chill surface 54a is facilitated by a gas jet or knife device 72 positioned in the quenching chamber 52 adjacent the chill surface 54a, FIG. 3, so as to direct a jet of inert gas, such as helium (see arrows), across the chill surface 54a substantially parallel therewith to blow rapidly solidified particulate P off the chill surface 54a. The gas jet device 72 also effects cooling of the chill disk 54 to maintain its temperature at an optimal value for rapid quenching of the undercooled droplets striking the chill surface 54a. Mechanical particulate removal devices, such as a wire brush device, can be used in addition to or in lieu of the jet device 72 to facilitate discharge of the solidified particulate from the chill surface 54a.

Also positioned in the quenching chamber 52 adjacent the upper perimeter of the chill surface 54a is a gas jet nozzle 74 for directing a jet of inert gas, such as helium, in such a downwardly inclined direction as to blow the solidified particulate discharged from the rotating chill surface 54a back toward the bottom of the quenching chamber 52 where a particulate separating device 80 is positioned between the quenching system 14 and collection system 16.

The particulate separating device 80 comprises an apertured separation grid or screen 82 (e.g., an array of parallel, longitudinal grids spaced apart by 2 mm to 6 mm) disposed across a lower tube-shaped extension 50c of the quenching chamber 52 and an exterior stainless steel bellows 84 for transferring vibratory motion from a vibrator device 86 to the separation grid 82.

The vibrating separating grid 82 is positioned so as to receive solidified particulate from the quenching chamber 52. The majority of the particulate received is properly undercooled and rapidly solidified in the form of elongate flakes or platelets while some minor portion of the particulate received is in the form of spheres as a result of insufficient undercooling and/or rapid solidification in the drop tube 12 and/or on the chill surface 54a. The vibrating separation grid 82 functions to pass the flake-shaped particulate through to the collection chamber 90 therebelow and to substantially prevent the spherical-shaped particulate from passing to the collection system 16. As a result, only the flake-shaped particulate which has been properly undercooled and rapidly solidified in accordance with the method of the invention reaches the collection system 16.

The flake-shaped particulate falls from the separation grid 82 through a frusto-conical converging throat 92 of the collection system 16 into the collection chamber 90. The collection chamber 90 includes a sealing tube 94 (pinch-off tube) connected beneath the throat 92 by a vacuum coupling 96. Once the collection chamber 90 is filled with the desired quantity of flake-shaped particulate, the sealing tube 94 is pinched off (crimped) and preferably electrical resistance welded at the pinched-off area to seal the particulate in the chamber 90. The sealed, particulate-filled collection chamber 90 is then removed from the throat 92 by releasing the coupling 96. Preferably, prior to removal of the particulate-filled chamber 90, the throat 92 and coupling 96 are evacuated to $10^{-9}$ torr.

The sealed, particulate-filled chamber 90 can then be transferred to a particulate consolidation station (not shown) where, for example, the sealed chamber 90 and its particulate contents can be compacted or pressed to form the particulate into a preliminary body of desired configuration. Generally suitable compaction processes involve die pressing, cold and/or hot isostatic pressing and/or extruding the sealed particulate filled chamber 90. The compacted body so formed may be in the form of a billet ready for mechanical reduction processing. Such billets can be processed by any mechanical reduction process including, but not limited to, forging, rolling, swaging, drawing and the like.

Figure 4:
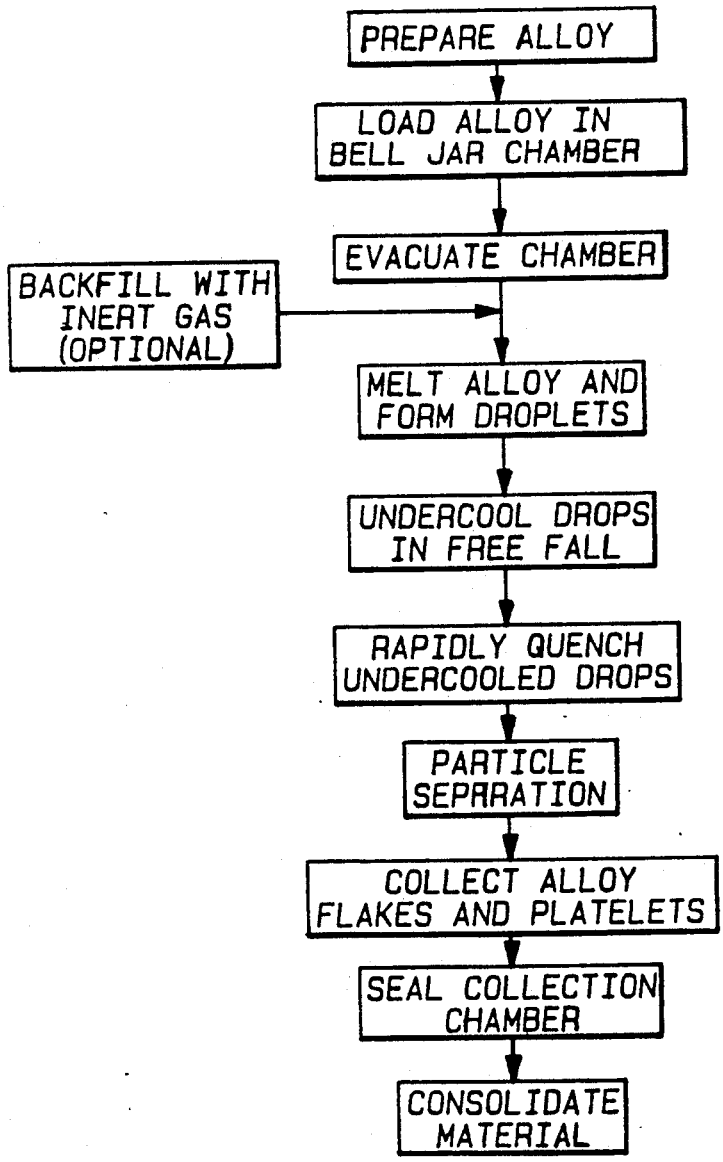
FIG. 4 is a block flow chart illustrating the general steps of one embodiment of the method of the invention.

As will be apparent from the description given hereinabove taken in conjunction with FIG. 4, one embodiment of the method of the invention involves forming the steam S of molten metal droplets D by melting the metallic charge in the molten metal stream forming system 10 and releasing molten droplets D to free fall as a discontinuous stream S through the drop tube 12. The droplets are undercooled by radiation heat loss if a relative vacuum is present in the drop tube 12. If a coolant gas, such as helium, is backfilled in the drop tube 12, the falling droplets D are undercooled by a combination of radiation and convection heat loss. The extent of undercooling achievable will depend upon the parameters described hereabove (e.g., droplet size, initial droplet temperature, drop tube length, and drop tube environment). The undercooled droplets D strike the inclined, rotating chill surface 54a of the chill disk 54 at the bottom of the drop tube 12. As a result, the undercooled droplets D are significantly sheared on the chill surface 54a and rapidly quenched thereon in the form of flake-shaped solidified particulate. The solidified, flake-shaped particulate may include metastable phases and ultra-fine microstructures (e.g., ultra-fine dendrites) as well as improved alloyant solubilities and reduced impurity segregation as a result of the undercooling followed by rapid solidification. The flake-shaped particulate so produced is discharged from the chill surface 54a by virtue of its rotation and smooth surface finish. The gas jet devices 72, 74 assist in removal of the particulate from the chill surface 54a and in directing the discharged particulate toward the separating device 80 for collection in the particulate collection chamber 90 and subsequent compaction after the particulate-filled chamber 90 is removed from the apparatus.

The method and apparatus of the invention have been illustrated hereinabove with respect to manufacture of metallic particulate by undercooling a discontinuous stream of molten droplets as they fall through the drop tube 12 and then rapidly quenching the undercooled droplets on the rotating, inclined chill surface 54a. However, the invention is not so limited and has wider applicability in making metallic particulate which is not undercooled prior to rapid solidification.

Figure 1B:
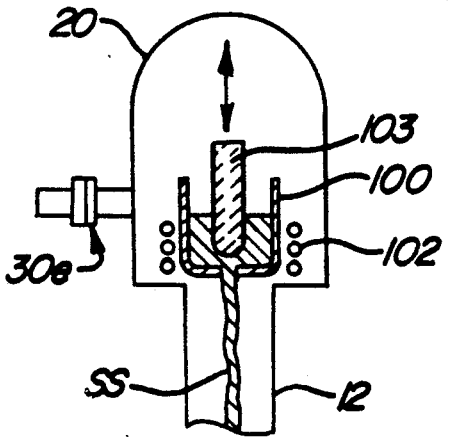
FIG. 1B is a partial diagrammatic view of another molten metal stream forming device to form an initially continuous stream of molten material to fall through the drop tube.

In particular, referring to FIG. 1B, an alternate molten stream forming system is shown for use in the apparatus of FIGS. 1-2. In FIG. 1B, like reference numerals are used to designate like features of FIGS. 1-2.

Figure 6:
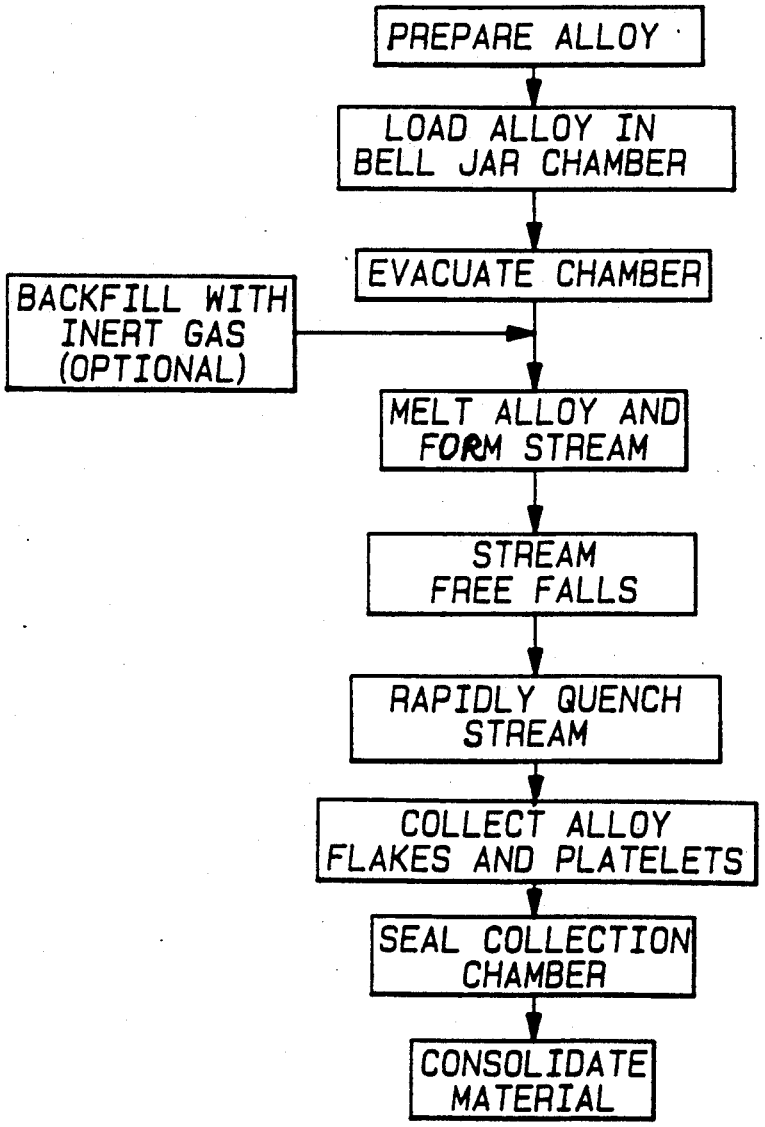
FIG. 6 is a block flow chart illustrating the general steps of another embodiment of the method of the invention where the molten material is rapidly solidified as particulate without prior undercooling.

In particular, the alternate molten metal stream forming system includes a crucible 100 and suitable heating means 102 (e.g., an induction coil, electron beam, laser, etc.) for melting a metallic charge and a stopper rod 103 openable to release the molten charge as a continuous stream SS of molten metal into the drop tube 12. The molten charge can be superheated in the crucible 100 to such an extent that the molten metal is not undercooled as it falls through the drop tube 12. The stream SS of superheated molten metal typically breaks up into droplets as the stream falls through the drop tube 12. The droplets formed by break-up of the continuous stream SS ultimately impinge on the rotating, inclined chill surface 54a shown in FIGS. 1-3 for extremely rapid quenching into solidified metallic particulate. The rapidly solidified particulate is discharged from the chill surface 54a and is collected in particulate collection chamber 90 for subsequent compaction, as described hereinabove with respect to FIGS. 1-3 and as further illustrated in FIG. 6. In this embodiment of the method of the invention where there is no undercooling of the molten metal prior to rapid solidification, there is no need for a particulate separation step.

Figure 5:
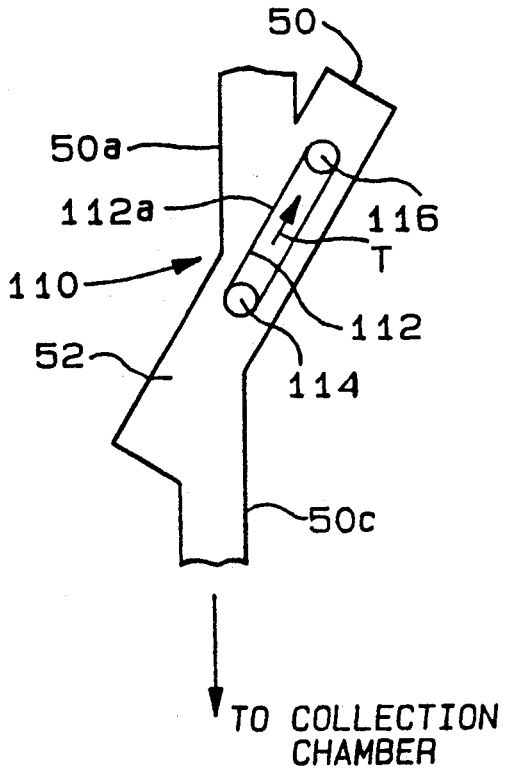
FIG. 5 is a diagrammatic perspective view of an endless chill (quench) belt and an extension of the drop tube.

FIG. 5 illustrates a chill device 110 which can be used in practicing the method and apparatus of the invention in lieu of the rotating chill disk 54 illustrated in FIGS. 1-3. In particular, the chill device 110 comprises an inclined endless chill belt 112 made of heat conductive material (e.g., copper) and rollers 114, 116 for supporting the endless chill belt 112. One or both of the rollers 114, 116 are driven in rotation by a suitable drive motor (not shown) to revolve the endless chill belt 112 beneath the bottom of the drop tube 12. The endless chill belt includes an upwardly facing, inclined chill (quench) surface 112a that is translated past the bottom of the drop tube 12 on rollers 114, 116. The arrow T illustrates the direction of translation of the chill surface 112a relative to the stream of molten metal. This direction as well as the speed and inclination of the chill surface 112a are selected to provide an upward component of motion of the chill surface 112a where the stream impinges on the chill surface 112a for the purposes described hereinabove with respect to the rotating, inclined chill disk 54; i.e., to achieve significant droplet shearing and enhanced molten metal quenching. Use of the endless chill belt 112 is advantageous to provide a uniform velocity at all locations on the chill surface 112a where the molten metal impinges. The gas jet device 72 described hereinabove as well as mechanical particulate removal devices can be used to facilitate removal of solidified particulate from the chill surface 112.

The rapidly solidified metallic particulate formed on the chill surface 112a is discharged when the belt 112 passes over upper roller 116. The rapidly solidified metallic particulate then falls by gravity toward a particulate collection system 16 like that illustrated in FIGS. 1-2.

As is apparent from the description set forth hereinabove, the invention provides a method and apparatus for making undercooled, rapidly solidified particulate in industrially useful quantities on a more or less continuous basis. Higher quench rates are achievable by virtue of impingement of the molten material against the moving, inclined chill surface of the disk 54 or endless belt 112 where the droplets are significantly sheared and rapidly solidified. Such higher quench rates improve the possibility of forming unique and/or improved metastable phases and fine microstructures in the particulate.

While the invention has been described in terms of specific embodiments thereof, it is not intended to be limited thereto but rather only to the extent set forth in the claims which follow.

We claim:

1. A method of making particulate, comprising:

(a) forming a falling stream of molten material, (b) solidifying the stream of molten material as flake-shaped particulate by impinging the molten material on a quench surface so inclined and moving relative to the stream as to have an upward component of motion counter to the downward direction of fall of the stream, and (c) discharging the solidified flake-shaped particulate from the quench surface.

2. The method of claim 1 wherein the stream of molten material is formed initially as a stream of molten material droplets.

3. The method of claim 2 including undercooling the droplets as they fall.

4. The method of claim 1 wherein the stream of molten material is formed initially as a substantially continuous molten stream.

5. The method of claim 4 wherein the continuous molten stream breaks apart as the steam falls to form molten droplets for impinging against the quench surface.

6. The method of claim 2 or 4 wherein the stream of molten material comprises superheated molten metal.

7. The method of claim 1 wherein the quench surface is inclined at an acute angle relative to the stream.

8. The method of claim 7 wherein the quench surface is inclined at an acute angle greater than 0 degrees to about 90 degrees relative to the stream.

9. The method of claim 1 including rotating the quench surface relative to the stream.

10. The method of claim 9 including providing the quench surface on a flat, circular, rotatable quench disk.

11. The method of claim 1 including translating the quench surface relative to the stream.

12. The method of claim 11 including providing the quench surface on an endless chill belt.

13. The method of claim 1 including subjecting the stream of molten metal to a vacuum of $10^{-9}$ torr as it falls.

14. The method of claim 1 including facilitating discharge of the solidified particulate from the quench surface by directing a gas jet across the quench surface.

15. The method of claim 3 including separating the particulate discharged from the quench surface so as to permit properly undercooled, rapidly solidified flake-shaped particulate to enter a collection chamber while substantially preventing improperly undercooled, rapidly solidified spherical particulate from entering the collection chamber.

16. Apparatus for making particulate, comprising:

(a) an upstanding enclosure, (b) means for forming a stream of molten material falling through the enclosure, (c) a quench surface disposed in the path of the stream of molten material for impingement of the molten material thereagainst to form solidified flake-shaped particulate, said quench surface being so inclined and moving relative to said stream as to have an upward component of motion counter to the downward direction of fall of the stream, and (d) means for moving the quench surface relative to the stream.

17. The apparatus of claim 16 including a collection chamber in proximity to the quench surface for receiving the solidified particulate from the quench surface.

18. The apparatus of claim 16 wherein the quench surface is inclined at an acute angle to the direction of fall of the stream.

19. The apparatus of claim 18 wherein the acute angle is greater than 0 degrees and less than 90 degrees.

20. The apparatus of claim 16 including means for evacuating the enclosure to a vacuum of at least about $10^{-9}$ torr.

21. The apparatus of claim 16 wherein the quench surface comprises a flat circular surface of a rotatable quench disk.

22. The apparatus of claim 16 wherein the quench surface comprises a flat upper surface of an endless quench belt.

23. The apparatus of claim 15 wherein said means for forming the stream of molten material comprises molten droplet forming means for forming a stream of molten droplets to fall downwardly through the enclosure.

24. The apparatus of claim 23 including means for undercooling the molten droplets as they fall.

25. The apparatus of claim 24 including separating means between the quench surface and the collection chamber for so separating said particulate as to permit properly undercooled/solidified flake-shaped particulate to enter the collection chamber while substantially preventing improperly undercooled solidified spherical particulate from entering the collection chamber.

26. The apparatus of claim 25 wherein the separating means comprises a vibrating apertured grid.

27. The apparatus of claim 16 wherein said means for forming the stream of molten material comprises means for releasing a continuous superheated molten stream into the enclosure.

28. The apparatus of claim 16 including means for directing a gas flow across the quench surface to facilitate discharge of the solidified particulate therefrom.

* * * * *

UNITED STATES PATENT AND TRADEMARK OFFICE

CERTIFICATE OF CORRECTION

PATENT NO. : 5,032,172

DATED : July 16, 1991

INVENTOR(S) : Ruel A. Overfelt et al

It is certified that error appears in the above-identified patent and that said Letters Patent is hereby corrected as shown below:

Drawings:

In Figure 2, add reference numeral 22 to designate the melting device comprising a rod or wire 26 fed into an electron beam furnace 28.

Signed and Sealed this

Fifth Day of April, 1994

Bruce Lehman

*Attest:*

BRUCE LEHMAN

*Attesting Officer*

*Commissioner of Patents and Trademarks*